US008254813B2

(12) United States Patent
Funamoto et al.

(10) Patent No.: US 8,254,813 B2
(45) Date of Patent: Aug. 28, 2012

(54) MULTICOLOR IMAGING SYSTEM

(75) Inventors: Noriaki Funamoto, Machida (JP); Yasuhisa Ehara, Kamakura (JP); Tetsuji Nishikawa, Machida (JP); Yasuhiro Maehata, Sagamihara (JP); Jun Yasuda, Matsudo (JP); Hiroaki Murakami, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 279 days.

(21) Appl. No.: 12/801,236

(22) Filed: May 28, 2010

(65) Prior Publication Data

US 2010/0303504 A1 Dec. 2, 2010

(30) Foreign Application Priority Data

Jun. 2, 2009 (JP) ..... 2009-133429

(51) Int. Cl.
*G03G 15/00* (2006.01)

(52) U.S. Cl. ..... 399/167; 399/299; 399/301; 399/302; 399/308; 399/66

(58) Field of Classification Search ..... 399/167, 399/299, 301, 302, 308, 66
See application file for complete search history.

(56) References Cited

U.S. PATENT DOCUMENTS

| | | | | |
|---|---|---|---|---|
| 5,881,346 | A | 3/1999 | Mori et al. | |
| 7,206,537 | B2 | 4/2007 | Funamoto et al. | |
| 7,352,978 | B2 | 4/2008 | Ebara et al. | |
| 7,369,795 | B2 | 5/2008 | Funamoto et al. | |
| 7,373,097 | B2 | 5/2008 | Ehara | |
| 7,532,842 | B2 | 5/2009 | Handa et al. | |
| 7,630,657 | B2 | 12/2009 | Ehara et al. | |
| 7,653,332 | B2 | 1/2010 | Ehara et al. | |
| 7,693,468 | B2 | 4/2010 | Ehara et al. | |
| 2004/0022556 | A1* | 2/2004 | Nomura | 399/116 |
| 2007/0097465 | A1 | 5/2007 | Kobayashi et al. | |
| 2007/0140736 | A1 | 6/2007 | Ehara et al. | |
| 2007/0166075 | A1 | 7/2007 | Funamoto et al. | |
| 2007/0196132 | A1 | 8/2007 | Kobayashi et al. | |
| 2008/0069604 | A1 | 3/2008 | Ebara et al. | |
| 2008/0131168 | A1 | 6/2008 | Ehara et al. | |
| 2008/0213000 | A1 | 9/2008 | Funamoto et al. | |
| 2008/0240754 | A1 | 10/2008 | Kobayashi et al. | |
| 2008/0282839 | A1 | 11/2008 | Suzuki et al. | |
| 2009/0285601 | A1* | 11/2009 | Akamatsu | 399/167 |
| 2010/0183322 | A1 | 7/2010 | Funamoto et al. | |
| 2010/0226676 | A1 | 9/2010 | Funamoto et al. | |
| 2010/0239318 | A1 | 9/2010 | Maehata et al. | |

FOREIGN PATENT DOCUMENTS

| | | |
|---|---|---|
| JP | 09-146329 | 6/1997 |
| JP | 2000-352851 | 12/2000 |
| JP | 2001-134039 | 5/2001 |
| JP | 2001-305820 | 11/2001 |
| JP | 2004-220006 | 8/2004 |
| JP | 3965357 | 6/2007 |
| JP | 2007-226206 | 9/2007 |

* cited by examiner

*Primary Examiner* — Ryan Walsh
(74) *Attorney, Agent, or Firm* — Harness, Dickey & Pierce, PLC

(57) ABSTRACT

A multicolor imaging system includes a controller which adjusts a phase difference in rotations of photoreceptors based on information detected by a rotary position detector, and drive elements for photoreceptors which generate a velocity fluctuation in the same cycle as that of a transfer unit. The controller is configured to concurrently adjust the phases of the photoreceptors and those of the drive elements so that a registration error in four color toner image on an intermediate transfer belt is reduced to a minimum.

8 Claims, 15 Drawing Sheets

FREQUENCY DECOMPOSITION

MULTICOLOR IMAGING SYSTEM

CROSS REFERENCE TO RELATED APPLICATION

The present application is based on and claims priority from Japanese Patent Application No. 2009-133429, filed on Jun. 2, 2009, the disclosure of which is hereby incorporated by reference in its entirety.

BACKGROUND OF THE INVENTION

1. Field of the Invention

The present invention relates to a multicolor imaging system such as a photocopier, a facsimile machine, or a printer which comprises a feed back controller to rotate a belt at a constant rotation rate.

2. Description of the Related Art

Recently, in the field of an imaging system such as a photocopier or a printer, there has been an increasing demand for not only higher speed printing but also higher quality color image generation along with the widespread use of imaging devices such as a digital camera. In order to satisfy such a demand, a tandem type color imaging system including respective imaging units for yellow, cyan, magenta, and black has been widely used. This system is configured to transfer and superimpose four color toner images onto a transfer element or an intermediate transfer element in sequence to generate a color image in a single image generation process.

However, there is a problem in such a system including an intermediate transfer belt as a transfer element onto which toner images are transferred from four photoreceptor drums that a moving velocity of the intermediate transfer belt is changed due to eccentricity of a drive roller therefor or an error in engagement of drive gears, causing a color registration error in the toner images and degrading quality of generated images. Further, when the ambient environment of the imaging system changes or the inner temperature of the system changes due to a continuous paper feed, a belt drive roller may expand or contract and the average moving velocity of the transfer belt may change, which causes extension or reduction of toner images in a sub scan direction and a color registration error in the toner images as well as degrades the quality of color images.

In view of solving such problems, various techniques have been developed (disclosed in Japanese Laid-open Patent Publication No. 2004-220006 (Reference 1), Japanese Patent No. 3965357 (Reference 2), Japanese Laid-open Patent Publication No. 9-146329 (Reference 3), No. 2001-134039 (Reference 4), No. 2001-305820 (Reference 5), for example).

References 1 and 2 disclose a technique to control an intermediate transfer belt to move at a constant velocity by attaching a scale and a reader to the transfer belt or an encoder on a shaft of a driven roller moved with the transfer belt to accurately detect a moving velocity of the transfer belt and feed back detected velocity data to a drive motor. References 3 to 5 disclose a technique to adjust initial phases of rotations of four photoreceptor drums so that positional shifts of four toner images are coherent with one another on the intermediate transfer belt for the purpose of substantially reducing color registration errors caused by a velocity fluctuation in drive elements of each photoreceptor drum.

However, since in References 1 and 2 the intermediate transfer belt and the photoreceptor drums are driven by the same motor aiming for manufactural costdown, the transfer belt can be moved at a constant velocity by controlling the motor to eliminate the velocity fluctuation therein; however, it may cause a velocity fluctuation in the photoreceptor drums driven with the intermediate transfer belt. As a result, the rotary velocity of the photoreceptor drums is fluctuated by an amount caused by the velocity fluctuation of drum drive elements plus an amount caused by the velocity fluctuation of the motor.

The technique in References 3 to 5 has a problem that a color registration error due to a velocity fluctuation of a transfer belt drive motor cannot be resolved even with the above adjustment of the initial rotary phases of the four color photoreceptor drums. The problem of image quality degradation remains unsolved.

Moreover, another problem is that a drive gear of a transfer unit may become eccentric when a transfer unit driver which rotates the transfer unit at a constant velocity and one of the photoreceptors are concurrently driven. This causes a fluctuation velocity in the one photoreceptor and a color shift between a toner image formed on the photoreceptor and toner images formed on the other photoreceptors, degrading image quality.

SUMMARY OF THE INVENTION

The present invention aims to provide a multicolor imaging system which comprises photoreceptors with drive elements driving the photoreceptors to generate a fluctuation in their rotary velocity in the same cycle as that of a transfer unit and which can generate high-quality color images with less color shifts at low manufacture cost by adjusting a phase difference between fluctuations of rotary velocities of the photoreceptors and those of their corresponding drive elements concurrently so that color registration errors in four color toner images on a no-end belt are reduced to a minimum.

According to one aspect of the present invention, a multicolor imaging system comprises a plurality of photoreceptors on which electrostatic latent images are generated, a plurality of develop units generating toner images based on the electrostatic latent images on the photoreceptors, respectively, a transfer unit comprising a no-end belt element onto which the toner images are transferred sequentially while rotated, and a belt drive element which rotates the belt element, a drive unit controlling the transfer unit via the belt drive element based on a fluctuation in a rotary velocity of the belt element so that the belt element rotates at a constant velocity, and driving one of the plurality of photoreceptors together with the belt element, a toner pattern detector which detects a toner pattern on the belt element, an arithmetic unit which calculates a periodic fluctuation in each of the photoreceptors from information detected by the toner pattern detector, a rotary position detector which detects rotary positions of the photoreceptors, a controller which adjusts a phase difference in rotations of the photoreceptors based on information detected by the rotary position detector, a drive gear system for the one photoreceptor, comprised of a gear and the belt drive element, and a gear system for the photoreceptors other than the one photoreceptor, comprised of a gear and at least one phase adjusting gear having a same rotary cycle as that of the gear of the drive gear system to adjust the rotary velocity of the photoreceptors other than the one photoreceptor to fluctuate in a same cycle as that of the one photoreceptor.

According to another aspect of the present invention, a multicolor imaging system comprises a plurality of photoreceptors on which electrostatic latent images are generated, a plurality of develop units generating toner images based on the electrostatic latent images on the photoreceptors, respectively, a no-end paper carrier on which a sheet of paper is carried and being rotated so that the toner images are transferred onto the sheet of paper sequentially, a paper carrier drive element rotating the paper carrier, a drive unit controlling the paper carrier drive element based on a fluctuation in a rotary velocity of the paper carrier so that the paper carrier rotates at a constant velocity, and driving one of the plurality of photoreceptors concurrently with the paper carrier, a toner pattern detector which detects a toner pattern on the paper carrier, an arithmetic unit which calculates a periodic fluctuation in a rotary velocity of each of the photoreceptors from information detected by the toner pattern detector, a rotary position detector which detects rotary positions of the photoreceptors; a controller which adjusts a phase difference between rotations of the photoreceptors based on information detected by the rotary position detector, a drive gear system for the one photoreceptor, comprised of a gear and the paper carrier drive element, and a gear system for the photoreceptors other than the one photoreceptor, comprised of a gear and at least one phase adjusting gear having a same rotary cycle as that of the gear of the drive gear system to adjust the rotary velocity of the photoreceptors other than the one photoreceptor to fluctuate in a same cycle as that of the one photoreceptor.

According to still another aspect of the present invention, a multicolor imaging system comprises a plurality of photoreceptors on which electrostatic latent images are generated, a plurality of develop units generating toner images based on the electrostatic latent images on the photoreceptors, respectively, a transfer unit comprising a no-end belt element onto which the toner images are transferred sequentially while rotated, and a belt drive element which rotates the belt element, a drive unit controlling the transfer unit via the belt drive element based on a fluctuation in a rotary velocity of the belt element so that the belt element rotates at a constant velocity, and driving one of the plurality of photoreceptors together with the belt element, a toner pattern detector which detects a toner pattern on the belt element, an arithmetic unit which calculates a periodic fluctuation in each of the photoreceptors from information detected by the toner pattern detector, a rotary position detector which detects rotary positions of the photoreceptors, a controller which adjusts a phase difference in rotations of the photoreceptors based on information detected by the rotary position detector, a drive gear system for the one photoreceptor, comprised of idle gears having a same rotary cycle and assembled so as to be reverse in phase to each other and to the belt drive element; and a gear system for the photoreceptors other than the one photoreceptor, comprised of a gear and at least one phase adjusting gear having a same rotary cycle as that of the belt drive element to adjust the rotary velocity of the photoreceptors other than the one photoreceptor to fluctuate in a same cycle as that of the one photoreceptor.

BRIEF DESCRIPTION OF THE DRAWINGS

Features, embodiments, and advantages of the present invention will become apparent from the following detailed description with reference to the accompanying drawings.

DETAILED DESCRIPTION OF THE PREFERRED EMBODIMENT

Figure 1:
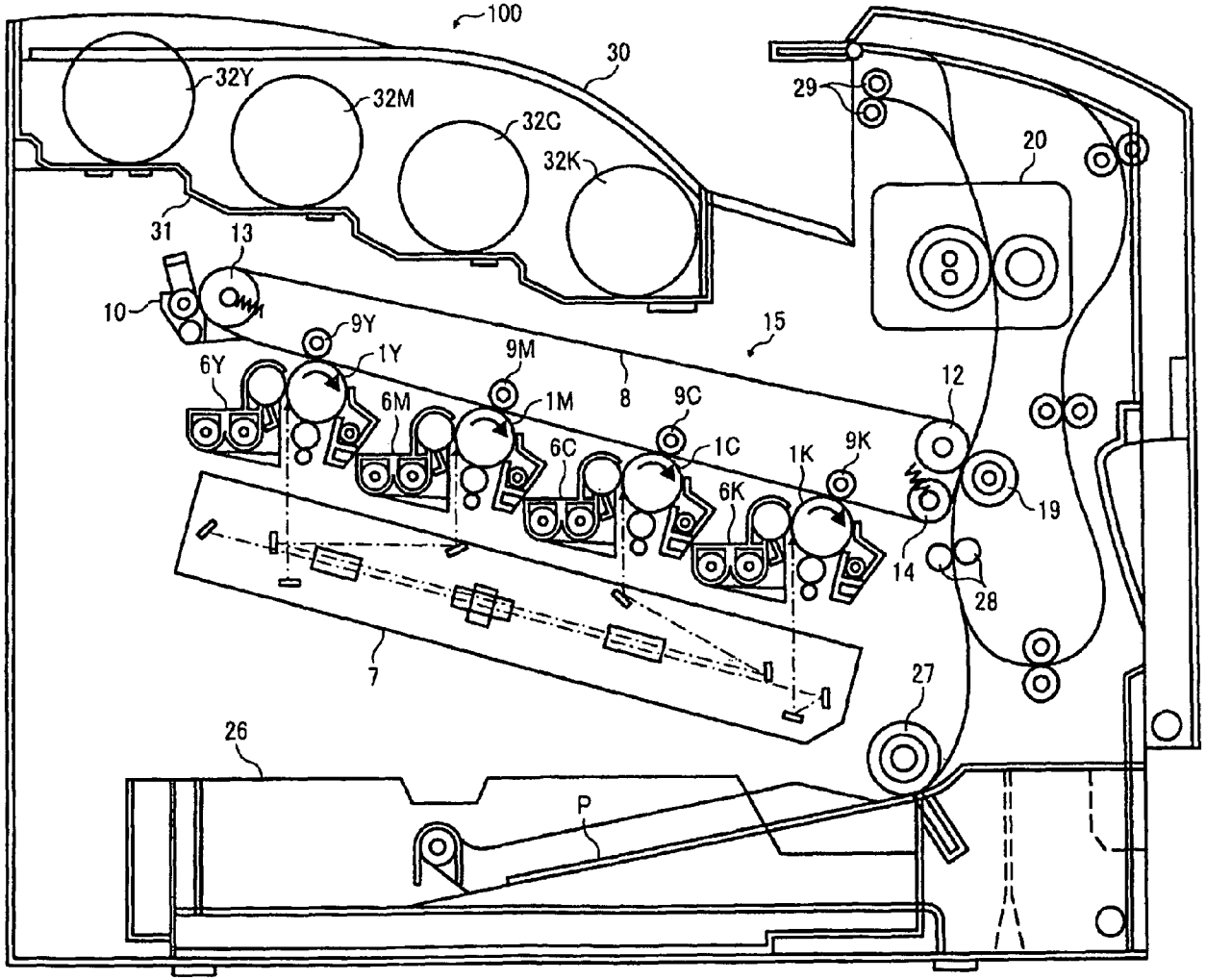
FIG. 1 schematically shows the structure of an electrophotographic type printer as an example according to one embodiment of the present invention.

Hereinafter, embodiments of the present invention will be described in detail using first to fifth examples with reference to the accompanying drawings. Herein, an electrophotographic type printer (hereinafter, printer) is exemplified as a multicolor imaging system to which the present invention is applicable. A process cartridge is used for an imaging unit by way of example. FIG. 1 shows the structure of one example of such a printer.

First, the basic structure of the printer is described. A printer 100 in FIG. 1 comprises four process cartridges 6Y, 6M, 6C, 6K which generate yellow, magenta, cyan, black (hereinafter, Y, M, C, K respectively) toner images. They have the same structure except the color of toners which are to be replaced when worn out. The process cartridge 6Y generating Y toner images is described by way of example. The process cartridge 6Y includes a photoreceptor drum 1Y, a not-shown drum cleaner, a neutralizer, an electric charger, a develop unit and else, and is detachable from the printer 100 so that all the consumables are replaceable at once.

The electric charger uniformly charges the surface of the photoreceptor drum 1Y rotated clockwise in the drawing. The charged surface is exposed with a laser beam and supports a yellow color electrostatic latent image, which is developed by the develop unit using a Y-toner. The Y-toner image is transferred onto an intermediate transfer belt 8 of an intermediate transfer unit 15. The drum cleaner removes remnant toner from the surface of the photoreceptor drum 1Y after the intermediate transfer process while the neutralizer neutralizes remnant charges on the photoreceptor drum 1Y. The surface of the photoreceptor drum 1Y is initialized by neutralization for the next image generation. Likewise, in the other process cartridges 6M, 6C, 6K, M-, C-, K-toner images are generated on the photoreceptor drums 1M, 1C, 1K respectively and transferred onto the intermediate transfer belt 8.

In FIG. 1 an exposure unit 7 is provided below the process cartridges 6Y, 6M, 6C, 6K to emit laser beams to the respective photoreceptor drums 1Y, 1M, 1C, 1K according to image information and expose them. Y-, M-, C-, K-electrostatic latent images are generated on the photoreceptor drums 1Y, 1M, 1C, 1K by exposure, respectively. Although not shown, the exposure unit 7 comprises a light source, a polygon mirror rotated by a motor, a plurality of lenses and mirrors and else so that a laser beam from the light source is reflected by the rotating polygon mirror to illuminate the photoreceptor drums 1Y, 1M, 1C, 1K via the lenses and mirrors. Below the exposure unit 7 a paper feed unit is provided which includes a paper cassette 26, a paper feed roller 27 assembled in the cassette 26, a resist roller pair 28 disposed downstream of the paper feed roller 27 and else. The paper cassette 26 accommodates a plurality of piled paper sheets P and the paper feed roller 27 is in contact with the topmost paper sheet P.

When the paper feed roller 27 is rotated by a not-shown drive element counterclockwise, the topmost paper sheet P is fed to the resist roller pair 28. The resist roller pair 28 rotates to hold the paper sheet P in-between them and temporarily stop rotating once holding the sheet P. Then, it emits the sheet P to a later-described secondary transfer nip at an appropriate timing. In such a paper feed unit the paper feed roller 27 and the resist roller pair 28 constitute a delivery element which delivers paper sheets P from the paper cassette 26 to the secondary transfer nip.

Above the process cartridges 6Y, 6M, 6C, 6K, the intermediate transfer unit 15 (transfer unit) comprises the intermediate transfer belt 8, four primary transfer bias rollers 9Y, 9M, 9C, 9K, a cleaning unit 10, a belt drive roller 12, a cleaning backup roller 13, a tension roller 14 and else to endlessly move the intermediate transfer belt (no-end belt element) 8. The intermediate transfer belt 8 is extended over the three rollers and moved endlessly counterclockwise by rotation of at least one of the rollers. The intermediate transfer unit 15 further comprises a belt drive roller 12 which also function as a secondary transfer backup roller.

The primary transfer bias rollers 9Y, 9M, 9C, 9K hold the endlessly moving intermediate transfer belt 8 with the photoreceptor drums 1Y, 1M, 1C, 1K, forming primary transfer nips, respectively. The primary transfer bias rollers 9Y, 9M, 9C, 9K apply transfer bias with opposite polarity to that of toners (positive when polarity of toner is negative, for example) to the back surface (inner circumference) of the intermediate transfer belt 8. All the rollers except the primary transfer bias rollers 9Y, 9M, 9C, 9K are electrically grounded. Along with movement of the intermediate transfer belt 8 passing the Y, M, C, K primary transfer nips, Y-, M-, C-, K-toner images are primarily transferred from the photoreceptor drums 1Y, 1M, 1C, 1K respectively and superimposed on the belt 8. Thereby, a four color toner image (hereinafter, four color toner image) is generated on the intermediate transfer belt 8.

The secondary transfer backup roller (belt drive roller) 12 forms a secondary transfer nip by holding the intermediate transfer belt 8 with a secondary transfer roller 19. The four color toner image is transferred onto a paper sheet P from the intermediate transfer belt 8 in the secondary transfer nip. After passing the secondary transfer nip, not-transferred remnant toner on the intermediate transfer belt 8 is removed by the cleaning unit 10. In the secondary transfer nip a paper sheet P is delivered in an opposite direction (to a fuser unit 20) to the resist roller pair 28, being held between the intermediate transfer belt 8 and the secondary transfer roller 19 both moving in a forward direction. Rollers of the fuser unit 20 apply heat and pressure to the paper sheet P emitted from the secondary transfer nip to fuse the transferred four color toner image thereon. Then, the paper sheet P is discharged to outside the printer via a discharge roller pair 29. A paper tray 30 is provided on the top face of a printer body and discharged paper sheets P are stacked thereon sequentially. Below the paper tray 30 four toner bottles 32Y, 32M, 32C, 32K are accommodated in a bottle container 31.

Figure 2:
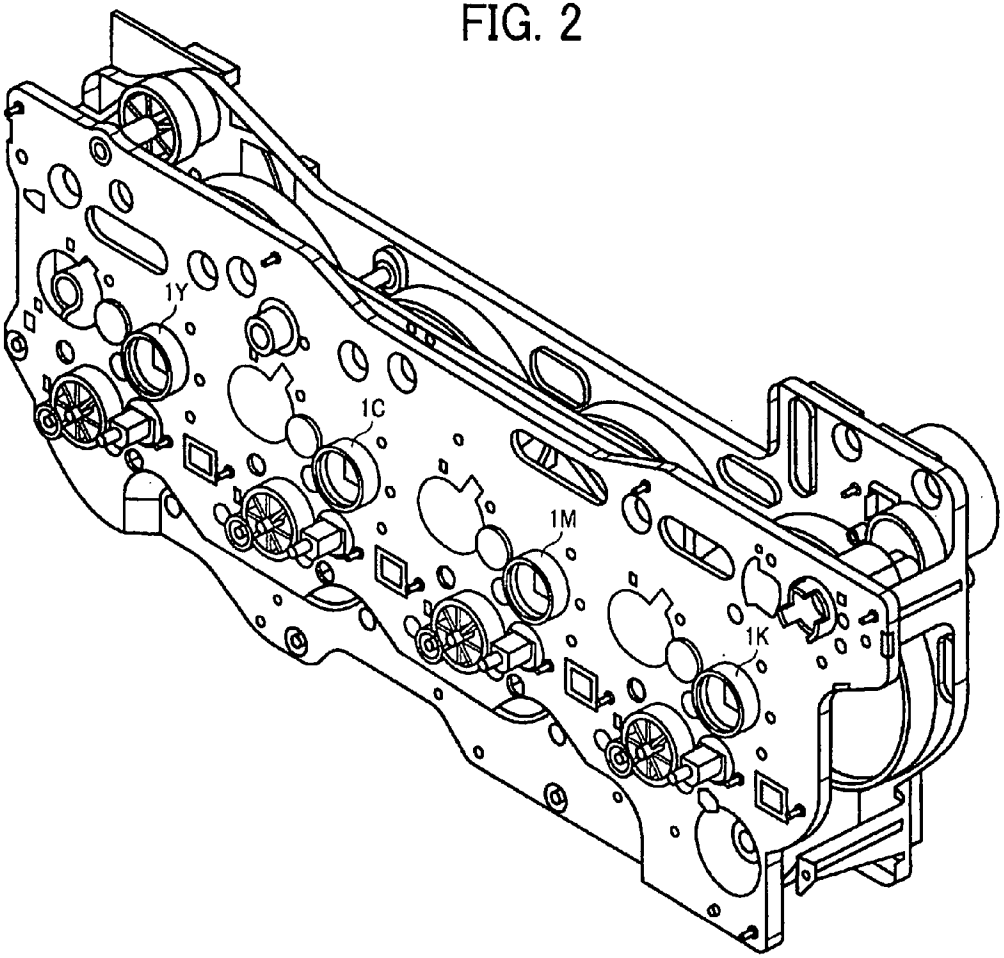
FIG. 2 is a perspective view of a drive unit for photoreceptor drums and an intermediate transfer belt.
Figure 3:
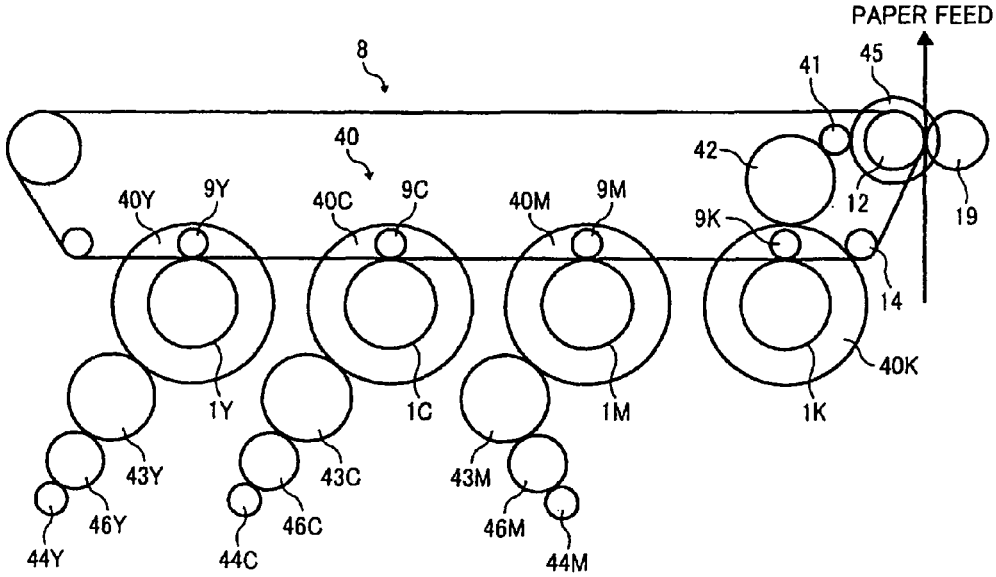
FIG. 3 schematically shows a first example of a drive system for the photoreceptor drums and an intermediate transfer belt according to one embodiment of the present invention.
Figure 4:
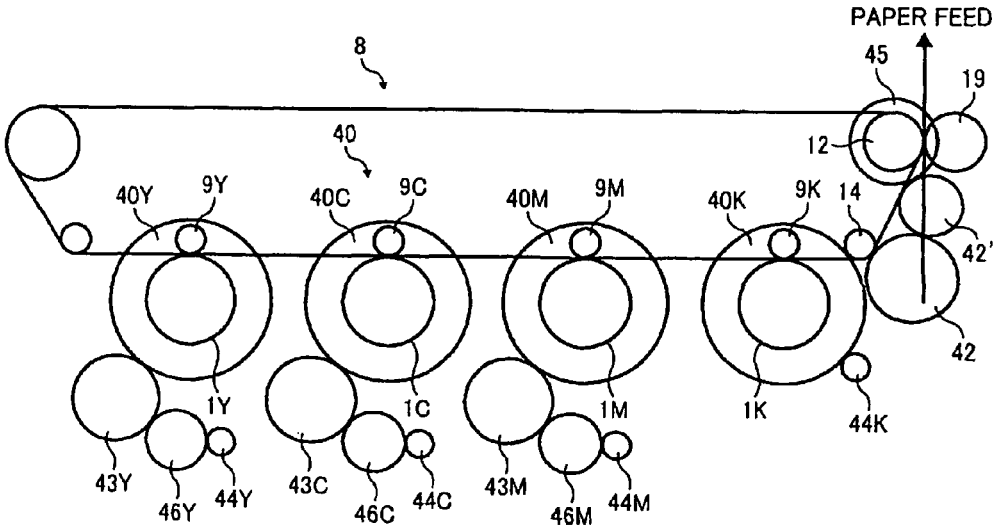
FIG. 4 schematically shows a second example of the drive system.
Figure 5:
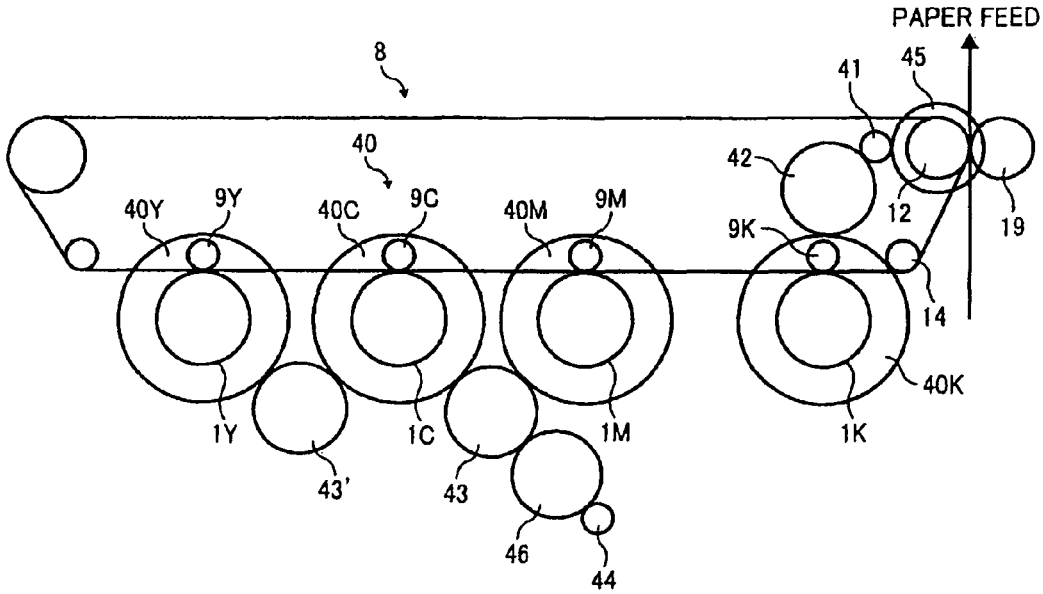
FIG. 5 schematically shows a third example of the drive system.

FIG. 2 is a perspective view of a drive unit of the photoreceptor drums and the intermediate transfer belt. FIG. 3 schematically shows a first example of a drive system for the photoreceptor drums and an intermediate transfer belt according to one embodiment of the present invention. FIG. 4 schematically shows a second example of the same and FIG. 5 schematically shows a third example of the same. In FIG. 2 only the photoreceptor drums 1Y, 1M, 1C, 1K are indicated with numeric codes. Note that the photoreceptor drums 1M, 1C in FIGS. 2 to 5 are differently positioned from those in FIG. 1. Also, note that in FIGS. 3 to 5 the same components are given the same numeric codes so that an overlapping description thereof is omitted, and the belt drive roller 12, transfer belt driven roller 14, secondary transfer pressure roller 19, and transfer belt drive gear 45 are shown.

FIRST EXAMPLE

Referring to FIG. 3, the first example of a drive unit is described according to one embodiment of the present invention. The belt drive roller 12 for the intermediate transfer belt 8 (belt element) and the black photoreceptor drum 1K are rotated by drive force from a drive motor 41 (drive unit). Specifically, the drive motor 41 (or gear provided on the drive shaft thereof) is connected with the transfer belt drive gear 45 coaxial with the belt drive roller 12, to drive the intermediate transfer belt 8. It is also connected with the black drum drive gear 40K via an idle gear 42 to drive the black photoreceptor drum 1K. Meanwhile, the other color photoreceptor drums 1Y, 1M, 1C are driven by drum drive motors 44Y, 44M, 44C, respectively. In order to reduce color shifts in toner images on the intermediate transfer belt 8 due to velocity fluctuations of the drum drive gear 40K and the other drum drive gears 40Y, 40M, 40C, first phase adjusting gears 43Y, 43M, 43C and second phase adjusting gears 46Y, 46M, 46C are provided for the drum drive gears 40Y, 40M, 40C. The first phase adjusting gears 43Y, 43M, 43C are set to have the same rotary cycle as that of the idle gear 42 and the second phase adjusting gears 46Y, 46M, 46C are set to have the same rotary cycle as that of the transfer belt drive gear 45.

The black drum drive gear 40K is driven by the drive motor 41 which also drives the intermediate transfer belt 8. The intermediate transfer belt 8 is rotated at a constant velocity under feedback control by adjusting velocity fluctuations due to eccentricity of the belt drive gear 45 or else, so that the adjusted velocity fluctuations are also transmitted to the black drum drive gear 40K. The other drum drive gears are, however, driven by the respective drive motors so that they are free from the influence from the intermediate transfer belt 8 (by the belt drive gear 45). Because of this, there will be a difference in rotary velocities between the black photoreceptor drum 1K and the other photoreceptor drums.

The phase adjusting gears are used in adjusting phases of the photoreceptor drums (later described) to generate a velocity fluctuation in the other photoreceptor drums in accordance with that in the black photoreceptor drum 1K. The second phase adjusting gears 46Y, 46M, 46C have the same rotary cycle as that of the transfer belt drive gear 45 to cause the same velocity fluctuation as that of the gear 45 in the drum drive gears 40Y, 40M, 40C, and the first phase adjusting gears 43Y, 43M, 43C have the same rotary cycle as that of the idle gear 42 to cause the same velocity fluctuation as that of the gear 42 in the drum drive gears 40Y, 40M, 40C, Accordingly, it is possible to accurately adjust a phase difference in rotations of the photoreceptor drums and prevent color shifts in toner images on the intermediate transfer belt 8. Note that needless to say, this is based on the premise that all the photoreceptor drums 1K, 1Y, 1M, 1C rotate in the same cycle and so do all the gears provided on the drive shafts of the drive motors.

According to embodiments of the present invention, the black photoreceptor drum 1K is the one driven by the same drive motor with the intermediate transfer belt 8. However, the present invention is not limited thereto. Any other photoreceptor drum can be driven by the same drive motor driving the intermediate transfer belt 8.

SECOND EXAMPLE

The second example of the drive system in FIG. 4 is different from that of the first example in the connection of the black photoreceptor drum 40K, transfer belt drive gear 45, and drive motor 41. Specifically, in the second example the drive motor 41 is connected with the black photoreceptor drum 40K to drive it and driving of the black drum 40K is transmitted to the transfer belt drive gear 45 via idle gears 42, 42' while in the first example the drive force of the drive motor 41 is directly transmitted to the transfer belt drive gear 45 and to the black drum gear 40K via the idle gear 42. The relations among the other drum drive gears, idle gears, and phase adjusting gears are the same as in the first example.

The idle gears 42, 42' are set to have the same rotary cycle as that of the first phase adjusting gears 43Y, 43C, 43M while the transfer belt drive gear 45 is set to have the same rotary cycle as that of the second phase adjusting gears 46Y, 46C, 46M. Thus, the second example can attain the same advantageous effects as those of the first example.

The two idle gears 42, 42' are provided between the black drum gear 40K and the transfer belt drive gear 45 in the second example. However, the number of idle gears can be arbitrary, one or three or more since gears having the same rotary cycle can generate the same velocity fluctuation irrespective of the number of gears connected.

THIRD EXAMPLE

The drive system in the third example in FIG. 5 differs from that in the first example in that the other photoconductor drums than the photoreceptor drum 1K are driven by a single drive motor 44. As shown in the drawing, the drive motor 44 (gear provided on the drive shaft) is connected with a second phase adjusting gear 46 which is connected with the first phase adjusting gear 43. The phase adjusting gear 43 is connected with the drum drive gears 40C, 40M to drive the photoconductor drums 1C, 1M. Further, another first phase adjusting gear 43' is provided between the drum drive gears 40C and 40Y to transmit driving of the drum drive gear 40C to the drum drive gear 40Y. The first phase adjusting gears 43, 43' have the same rotary cycle as that of the idle gear 42 while the second phase adjusting gear has the same rotary cycle as that of the belt drive gear 45. This makes it possible to accurately adjust phases of rotary velocity fluctuations in the four photoreceptor drums and prevent color shifts in the toner images on the intermediate transfer belt 8.

With such a configuration, the drum drive gears 40M, 40C are driven by drive force which is transmitted via the drive motor 44, the second phase adjusting gear 46, and the first phase adjusting gear 43 in order. The drum drive gear 40Y is driven by drive force transmitted via the drive motor 45, the second phase adjusting gear 46, the first phase adjusting gear 43, the drum drive gear 40C, and the first phase adjusting gear 43' in order.

The number of phase adjusting gears between the drum drive gear 40Y and the drive gear 44 is larger by one (phase adjusting gear 43') than between the other drum drive gears 40C, 40M and the drive gear 44. However, the second phase adjusting gears 43, 43' have the same rotary cycle as described above so that a generated velocity fluctuation will not change according to the number of phase adjusting gears. Therefore, the effect thereof will not change.

As configured above, the drive system in the third example can realize the same effects as those in the first and second example. In addition, with a reduction in the numbers of the drive motors and phase adjusting gears, it is able to simplify the structure of the drive system and reduce the manufacture costs.

Note that the arrangement of the drum drive gears 40Y, 40C, 40M can be arbitrarily changed.

Figure 6:
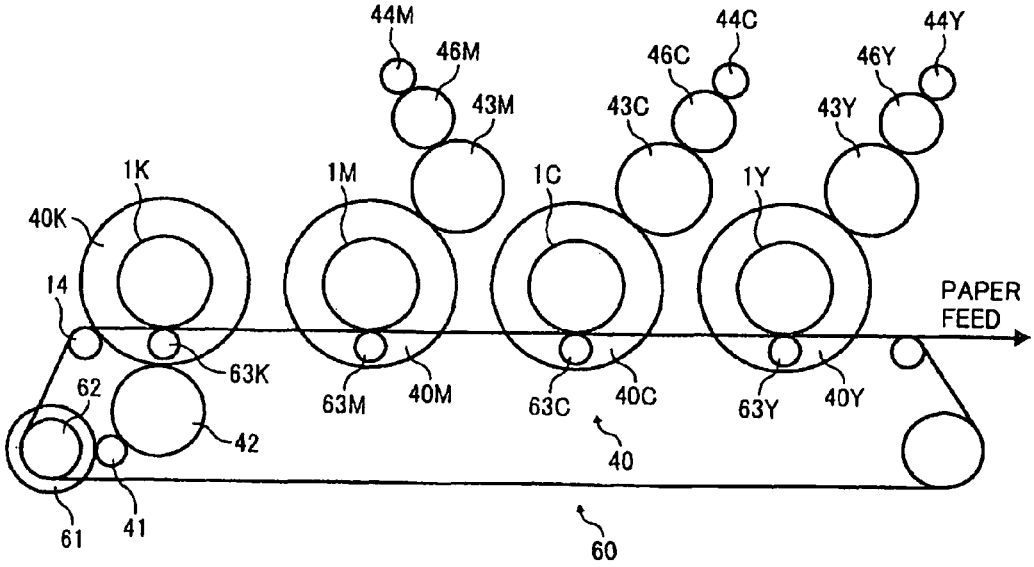
FIG. 6 shows an example in which the first example of a drive system is applied to a direct transfer type printer.

Next, FIG. 6 shows an example in which the drive system in the first example is applied to a direct transfer type printer. In FIG. 6 a carrier belt 60 (paper carrier) extends over a belt drive roller 62 delivering paper sheets in a direction of the arrow in the drawing and a tension roller 14 and others and is endlessly moved clockwise by rotation of the drive roller 62. Transfer bias rollers 63Y, 63M, 63C, 63K hold the moving carrier belt 60 with the photoreceptor drums 1Y, 1M, 1C, 1K to form transfer nips, respectively. Four color toner images (Y, M, C, K) on the photoreceptor drums are transferred onto a paper sheet carried by the carrier belt 60 and sequentially passing through the transfer nips and a four color superimposed toner image (hereinafter, four color toner image) is formed.

The drive system shown in FIG. 6 is used with a different transfer system from that in the first example. However, the second phase adjusting gears 46Y, 46C, 46M having the same rotary cycle as that of the belt drive roller 62 are provided for the photoreceptor drums 1Y, 1C, 1M in order to reduce a velocity fluctuation due to the belt drive roller 62, as in the first example. Therefore, the same advantageous effects can be attained in this example. Further, the drive systems in the second and third examples can be also applied to a direct transfer type printer.

Figure 7:
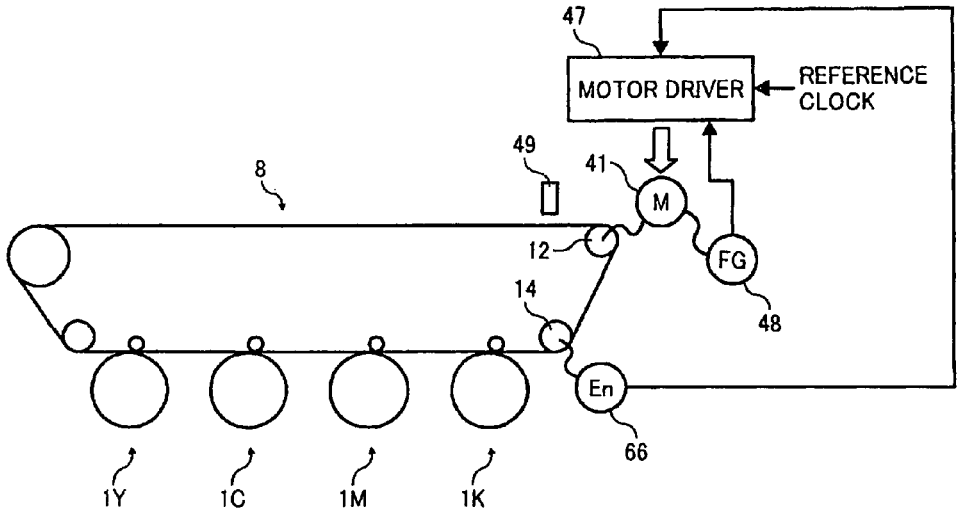
FIG. 7 is a block diagram of a control system for the intermediate transfer belt.
Figure 8A:
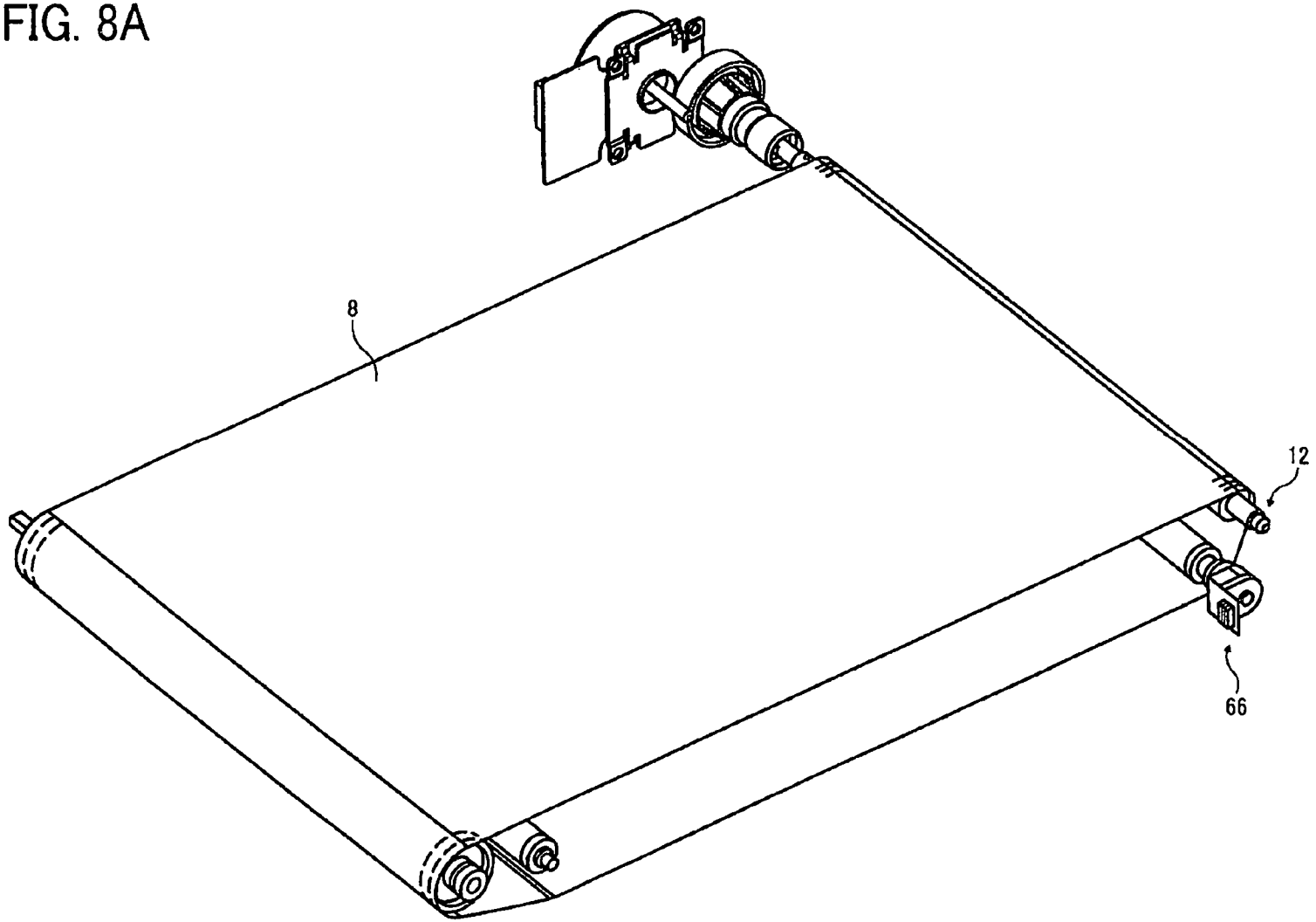
FIG. 8A shows an encoder attached to a driven roller and FIG. 8B shows a drive motor and a drive gear.
Figure 8B:
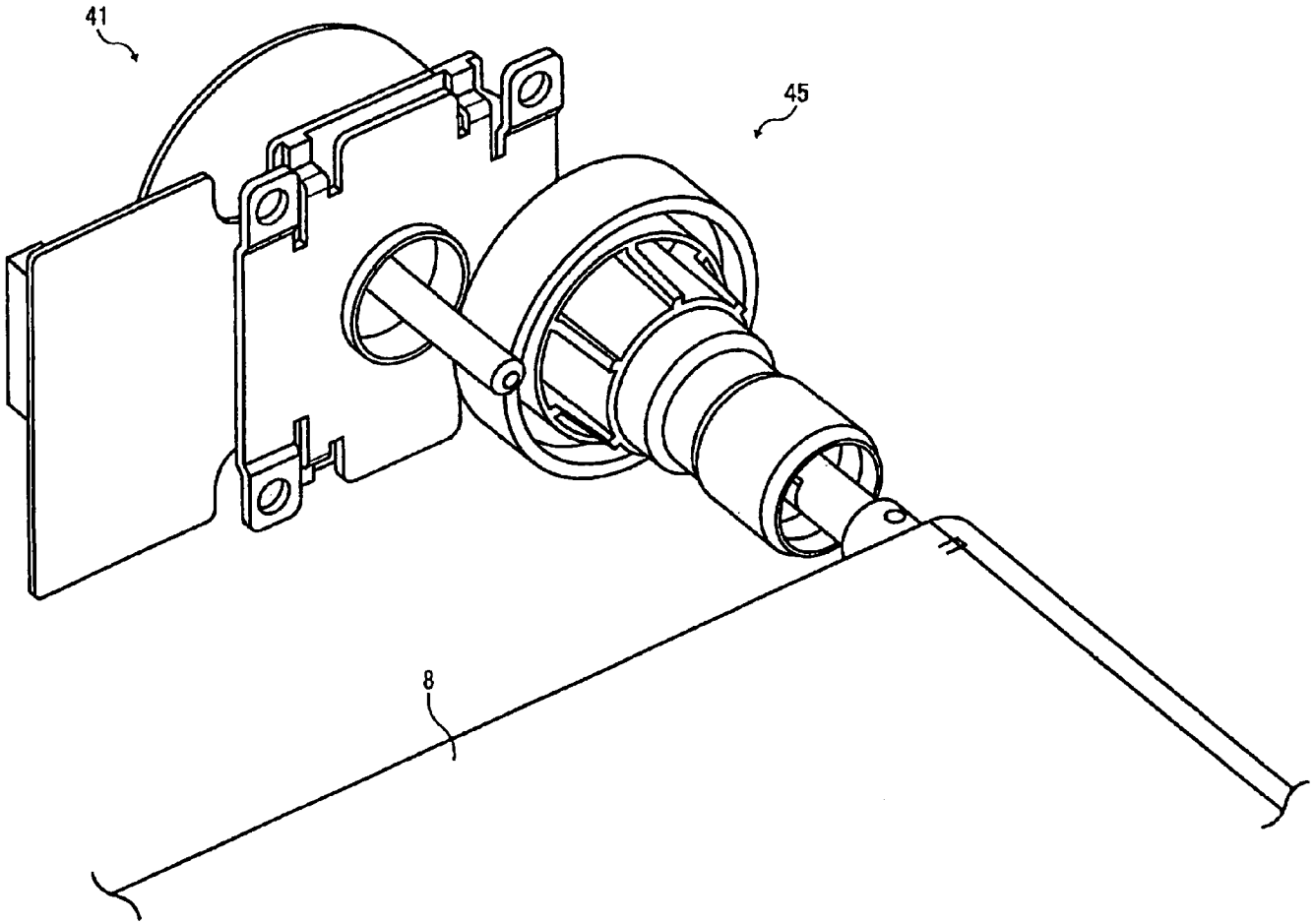

Next, drive control of the intermediate transfer belt 8 is described with reference to FIG. 7 and FIGS. 8A, 8B. FIG. 7 shows how the intermediate transfer belt is controlled, FIG. 8A schematically shows the position of an encoder mounted on the driven roller, and FIG. 8B schematically shows the positions of the drive motor and the drive gear. In a drive unit in FIG. 7 an encoder 66 is coaxially mounted on the driven roller 14 as a tension roller which is rotated with the intermediate transfer belt 8. By rotation of the driven roller 14, pulse signals are output from the encoder 66 to a motor driver 47 of the transfer belt drive motor 41.

The motor driver 47 is configured to perform phase locked loop (PLL) control (acceleration/deceleration) over the transfer belt drive motor 41 so that a phase difference of frequencies of a reference clock signal for setting a rotary velocity and an output signal from a not-shown rotor become constant. Therefore, using signals from the encoder 66, it is possible to control the transfer belt drive motor 41 to rotate a driven shaft to which the encoder 66 is attached at a constant velocity.

Thus, the encoder 66 is attached to the driven roller 14 rotated with the intermediate transfer belt 8. By feeding back pulse signals from the encoder 66 to the motor driver 47 and performing PLL control over the belt drive motor 41 so that the pulse signals of the encoder 66 and the reference clocks are coherent with each other in phase, the driven roller 14 can be rotated at a constant velocity or the intermediate transfer belt 8 can be controlled to move at a constant velocity, even with an occurrence of decentering of the drive roller 12 or belt drive gear 45 (FIGS. 3 to 5) engaging with the drive roller 12, or an unexpected disturbance.

Note that in replace of the encoder 66 of the driven roller 14, markings can be provided on the circumference of the intermediate transfer belt with an equal interval to obtain pulse signals in proportion to the surface velocity of the intermediate transfer belt 8 with a reflective sensor or a transmissive sensor. Also, note that the transfer belt drive motor 41 comprises a frequency signal generator 48 with a sensor coil on a not-shown board which generates frequency signals (FG signal) in proportion to the rotary velocity of the drive motor 41 from the sensor coil.

The FG signals are also input to the motor driver 47 of the transfer belt drive motor 41. Thereby, the driven shaft to which the encoder 66 is attached can be rotated at a constant velocity by controlling the pulse signals of the encoder 66 while the transfer belt drive motor 41 can be rotated at a constant velocity by controlling the FG signals. Which of the signals, the FG signal or pulse signal, is to be controlled can be arbitrarily selected with a not-shown switch inside the motor driver 47. Alternatively, it can be automatically determined by the multicolor imaging system depending on a printing condition or the like.

As described above, with a velocity fluctuation in the moving intermediate transfer belt 8, the encoder 66 detects the fluctuation and the drive motor 41 is controlled to move the intermediate transfer belt 8 in the opposite direction at such a velocity as to negate the velocity fluctuation. However, the velocity fluctuation of the intermediate transfer belt 8 by the drive motor 4 is transmitted to the photoreceptor drum 1K connected with the intermediate transfer belt 8 via the belt drive gear 45 and the idle gear 42 (FIG. 3).

Moreover, with provision of the drum drive gear 40K coaxially positioned with the photoreceptor drum 1K via a joint or the transfer belt idle gear 42, the rotary velocity of the photoreceptor drum 1K fluctuates due to gear errors or decentering of assembled elements even if the transfer belt drive motor 41 is rotated at a constant velocity. Therefore, the velocity fluctuation occurs in the photoreceptor drum 1K due to a fluctuation in a rotation cycle of the drive roller 12 and that in a rotation cycle of the idle gear 42 and drum drive gear 40K.

With the velocity fluctuation in the photoreceptor drum 1K while the intermediate transfer belt 8 is moved at the constant velocity, the rotary velocity of the photoreceptor drum 1K when exposed for latent image generation may differ from that at a primary transfer to the intermediate transfer belt 8. This causes a problem that a toner image is transferred onto a position shifted from a target position. For example, when the photoreceptor drum 1K moving at a rotary velocity faster than a predetermined velocity is exposed with a laser beam constantly irradiated, a toner latent image is generated at a position shifted backward from a predetermined position. Likewise, when the velocity of the photoreceptor drum 1K is slower than that of the intermediate transfer belt 8 at a primary transfer, a toner image is transferred onto a position on the intermediate transfer belt 8 shifted backward from a predetermined position.

Thus, with the photoreceptor drum 1K moving faster than the intermediate transfer belt 8 at exposure and slower at transfer, or the photoreceptor drum 1K moving slower than that at exposure and faster at transfer, a shift in the position of the transferred toner image is largest. Different positional shifts in all of the four transferred images due to the velocity fluctuations of the four photoconductor drums lead to positional shifts in the four color toner image, resulting in degrading the quality of a generated image with color shifts.

In view of preventing the above problems, the imaging system according to the present embodiment comprises a toner pattern detector 49 (FIG. 7) to read patterns formed with constant interval on the intermediate transfer belt 8 by rotating all the photoreceptor drums 1Y, 1M, 1C, 1K. Thereby, it is possible to find fluctuations in the rotary velocity of the photoreceptor drums 1Y, 1M, 1C, 1K by measuring positions of pattern intervals according to signals output from the toner pattern detector 49.

Figure 9:
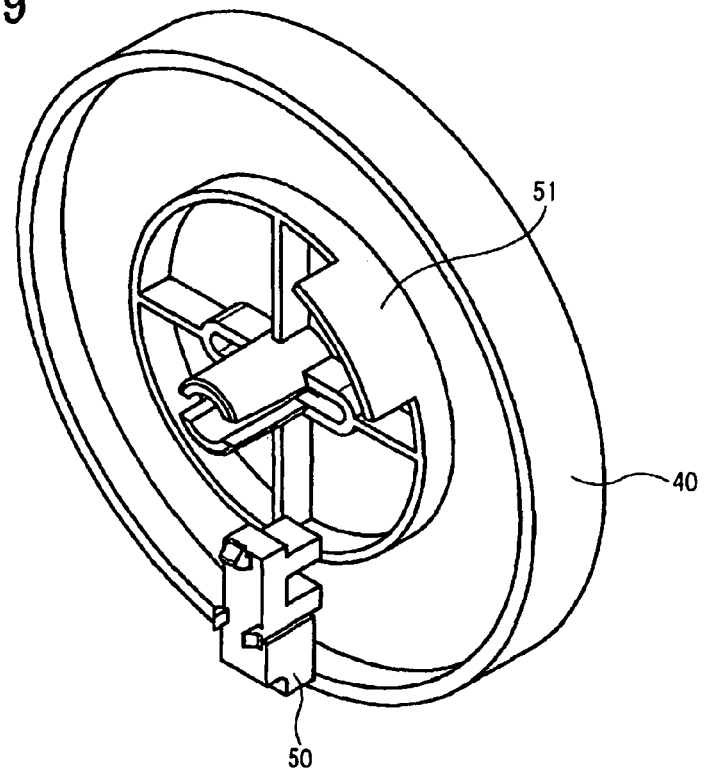
FIG. 9 is a perspective view of a wheel provided in the drive gear of the photoreceptor drum.

FIG. 9 is a perspective view of a wheel of each of the drum drive gears 40 having a drum position detector 50. As shown in FIG. 7, the drum position detectors 50 read signals passing on wheels 51 so as to associate phases of the velocity fluctuation with the positions of the photoreceptor drums 1Y, 1M, 1C, 1K, respectively while the velocity fluctuations of the photoreceptor drums are found from the signals from the toner pattern detector 49 (FIG. 7), and to find a phase difference among the velocity fluctuations of the photoreceptor drums 1Y, 1M, 1C, 1K so that a registration error in the four color toner image is to be least.

In addition, in the monochrome printing mode only the black photoreceptor drum 1K which is the one driven with the intermediate transfer belt 8 is rotated so that the velocity fluctuation thereof is shifted in phase from that of the other photoreceptor drums. Therefore, it is necessary to adjust the rotary phase of the photoreceptor drum 1K to be coherent with that of the other photoreceptor drums after completion of the printing. The drum position detector 50 of the wheel 51 is configured to count the rotation rate of the drum drive gear 40K, and the photoreceptor drum 1K is stopped driving based on the rotation rate to return to the original state (in-phase state). For instance, suppose that the drum drive gears 40 are rotated at a rate in multiples of 36 in the above drive unit, the rotary phases of all the velocity varying elements can be returned to the ones before the rotation.

Figure 10:
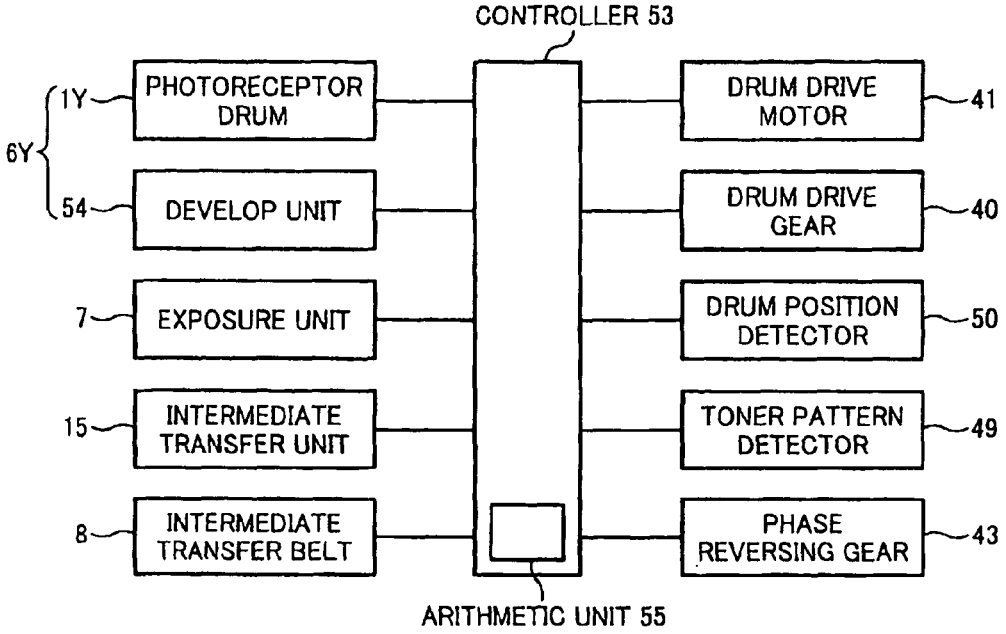
FIG. 10 is a block diagram of a drive control system according to one embodiment of the present invention.

FIG. 10 is a block diagram of a drive controller (controller) which controls the elements to prevent color shifts in images of the imaging system according to the present embodiment. The drive controller in FIG. 10 is described referring back to FIGS. 1 to 9. In the multicolor imaging system it is configured to concurrently adjust velocity fluctuations of the photoreceptor drums 1 (1Y, 1M, 1C, 1K) and those of the drum drive gears 40. A controller 53 is connected with the process cartridges (6Y, 6M, 6C, 6K) including the photoreceptor drums 1, the develop units 54 and with the intermediate transfer unit 15. The develop units 54 generate visible images using a developer including toner based on electrostatic latent images formed on the photoreceptor drums 1Y, 1M, 1C, 1K. The intermediate transfer unit 15 transfers and superimposes the toner images in sequence on the intermediate transfer belt 8.

Note that since there are four color electrophotographic processing units, hereinafter "photoreceptor drum 1" is referred to as any of the photoreceptor drums 1Y, 1M, 1C, 1K, and the same applies to "process cartridge 6" and "develop unit 54".

Moreover, the controller 53 is connected with the belt drive motor 41 to drive the intermediate transfer belt 8 to rotate at a constant velocity based on a detected velocity fluctuation therein, the toner pattern detector 49, an arithmetic unit 55 finding a periodic velocity fluctuation of the photoreceptor drums 1Y, 1M, 1C, 1K from information from the toner pattern detector 49, drum position detectors (rotary position detector) 50 detecting rotary positions of the respective photoreceptor drums and phase adjusting gears 43 adjusting rotary positions thereof according to a found velocity fluctuation in order to adjust phases of the photoreceptor drums. The controller 53 adjusts a phase difference among the rotation velocity of the photoreceptor drums 1Y, 1M, 1C, 1K based on information detected by the drum position detector 50 while the transfer belt motor 41 drives one of the photoreceptor drums together with the intermediate transfer belt 8. For driving the photoreceptor drum 1K by the belt drive motor 41, for example, the phase adjusting gears are provided for the other photoreceptor drums 1M, 1C, 1K as drive elements generating a velocity fluctuation in the same cycle as that of the velocity fluctuation in the intermediate transfer unit 15. The controller 53 concurrently adjusts phase differences in the velocity fluctuations of the photoreceptor drums 1Y, 1M, 1C, 1K and of the phase adjusting gears so that a registration error in the four toner images on the intermediate transfer belt 8 is to be least.

Upon completion of a monochrome printing mode, the photoreceptor drums and the drive gears are stopped rotating after the phase adjustment of their respective velocity fluctuations. This can shorten a time taken for adjusting the phase differences in the velocity fluctuations to be coherent with each other for the next color printing and reduce a wait time of users. Further, in a color printing mode immediately after the monochrome printing, stopping the black photoreceptor drum 1K for rotary phase adjustment is undesirable to do with users' wait time taken into consideration. Therefore, the controller 53 controls the other color drum drive motors to start based on the rotation rate of the black photoreceptor drum 1K which is constantly counted by the drum position detector 50 of the wheel 51 of the drum drive gear 40K. This makes it possible to shorten the time for rotary phase adjustment of the black station and the other color stations and to reduce the users' wait time.

Figure 11A:
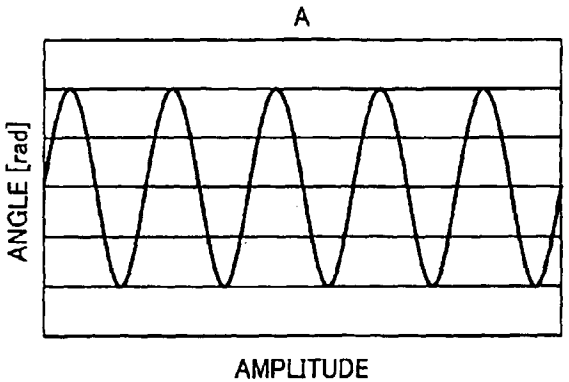
FIGS. 11A to 11D show synthetic waves of velocity fluctuation occurring on a black photoreceptor drum.
Figure 11B:
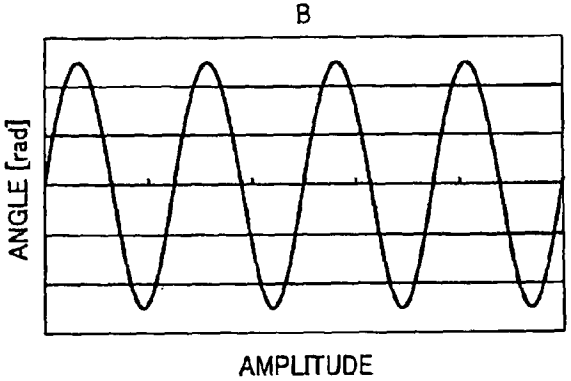
Figure 11C:
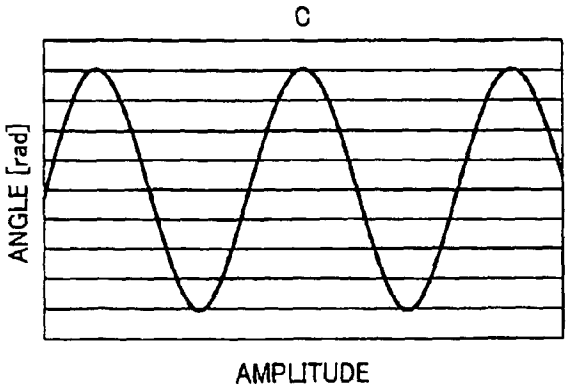
Figure 11D:
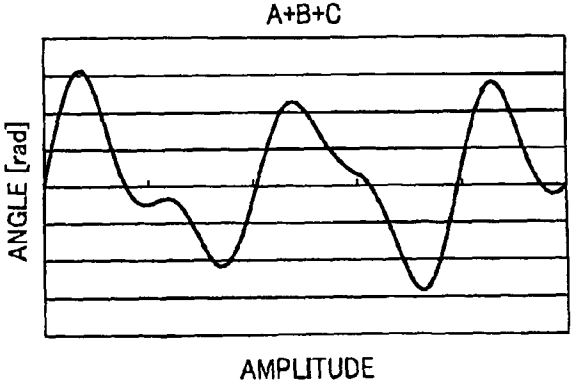

FIGS. 11A to 11D show synthetic waves of periodic fluctuations in different velocities occurring on the black photoreceptor drum 1K, and FIG. 11D shows a synthetic wave (A+B+C) of a sine wave A in FIG. 11A, a sine wave B in FIG. 11B, and a synthetic wave C in FIG. 11C. The synthetic wave as in FIG. 11D occurs on the photoreceptor drum 1K due to the above-described concurrent velocity fluctuation at different frequencies. The frequencies of the velocity fluctuations can be estimated from the shape of drive elements, and the amplitude and phase of the pattern intervals can be calculated from the cycle and phase components and quadrature components of fluctuated components using a known technique (quadrature detection, for example) adopted in a demodulation circuit in the communication technology. With provision of phase adjusting gears in the other drum drive gear trains rotating at the same cycle (gear ratio) as that of the belt drive gear and the belt idle gear, the phases of all the velocity fluctuations of the photoreceptor drum 1K can be adjusted to be coherent with those of the other photoreceptor drums.

Figure 12A:
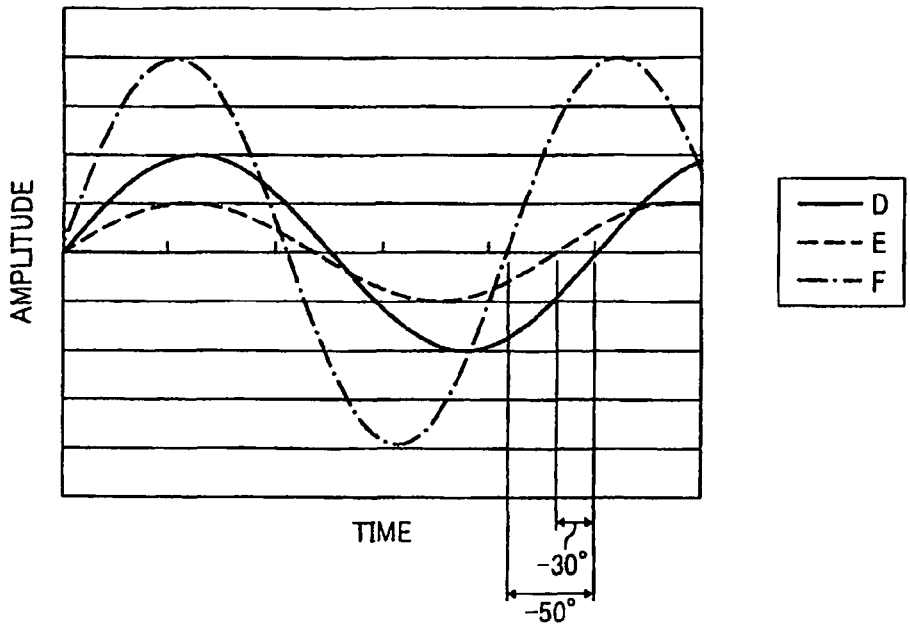
FIG. 12A is a graph showing velocity fluctuations of a drum drive gear, an idle gear and a transfer belt drive gear (drive roller)
Figure 12B:
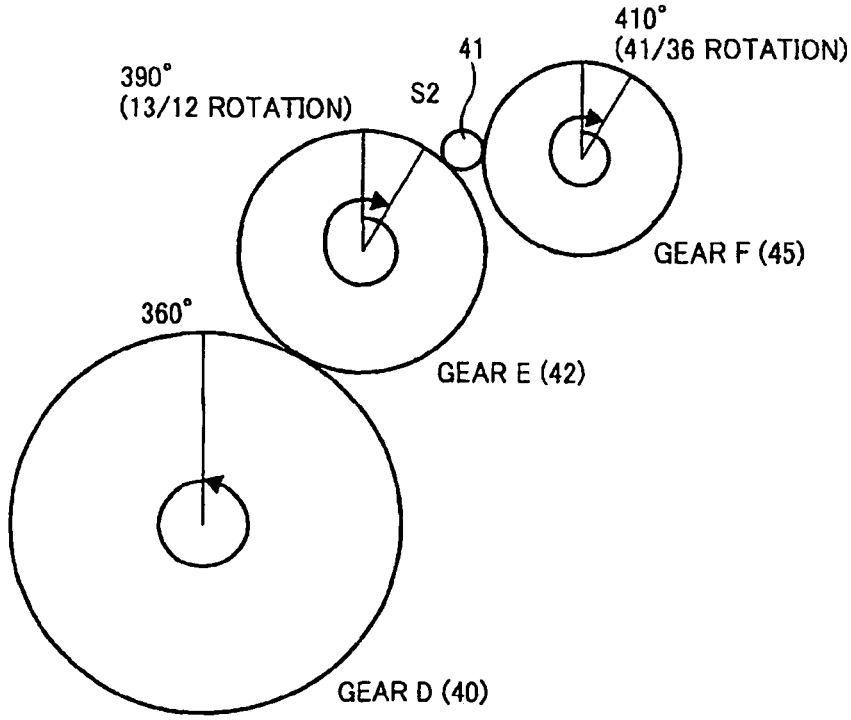
FIG. 12B shows the rotations of these gears.

FIG. 12A is a graph showing velocity fluctuations D, E, F of the drum drive gear 40, belt idle gear 42, and belt drive gear 45, respectively. FIG. 12B shows rotations of these gears. Referring to FIG. 3 and FIGS. 12A, B, gears D, E, F with different rotation cycles are provided in the drive gear trains of the photoreceptor drums 1Y, 1M, 1C, respectively.

Figure 13A:
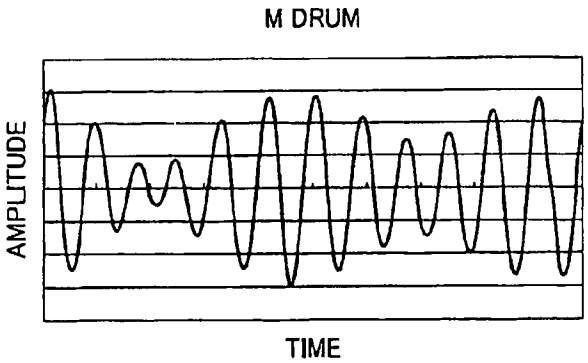
FIGS. 13A to 13E show frequency decomposition of velocity fluctuation on black and magenta photoreceptor drums.
Figure 13B:
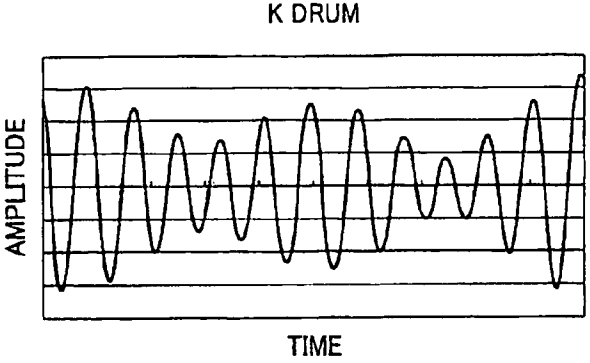
Figure 13C:
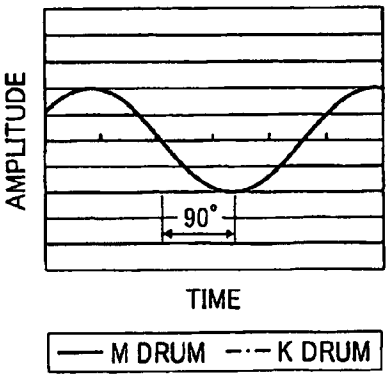
Figure 13D:
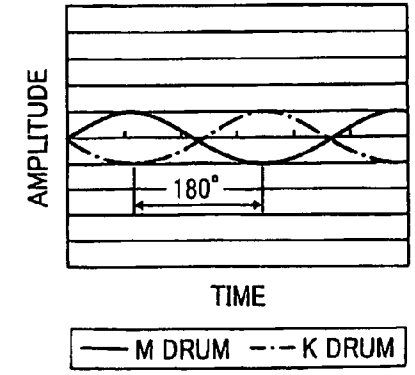
Figure 13E:
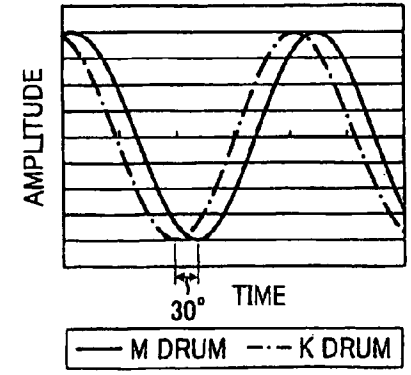

FIGS. 13A to 13E show frequency decomposition of velocity fluctuations of the magenta and black photoreceptor drums 1M, 1K. FIGS. 13A and 13B show a synthetic wave of periodic fluctuations at different velocities on the magenta and black photoreceptor drums 1M, 1K while FIGS. 13C to 13E show a phase difference of the velocity fluctuations therebetween.

Figure 14A:
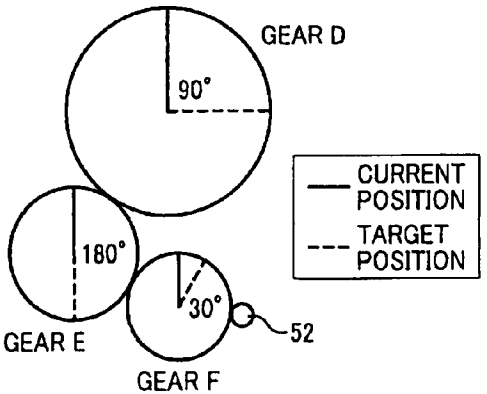
FIGS. 14 show how rotation of a magenta drum gear train is changed.

FIG. 14A to 14D shows how the rotation of a gear train for the magenta photoreceptor drum 1M changes in the photoreceptor unit of FIG. 4. In FIG. 14A the current positions of gears D, E, F are indicated by solid lines and the target positions are indicated by broken lines and defined to be reference positions. The rotation angles of them from the reference positions are controlled. In FIG. 14A the gear D is rotated by −90°, the gear E is rotated by +180°, and the gear F is rotated by −30° from their respective reference positions. In the following, the control process to prevent color shifts in images transferred from the magenta and black photoreceptor drums 1K, 1M will be described. Assumed that phase shifts of the rotation (rotation angle) of the respective gears shown in FIGS. 14C to 14E occur as a result of the frequency decomposition in FIGS. 13A, 13B to these photoreceptor drums when the photoreceptor drum 1K is connected with the transfer belt drive motor via a gear and the magenta photoreceptor drum 1M is driven by a different drive motor.

FIGS. 14B to 14E show positions (phase and rotation angle) of the gear train after the gear D is rotated by 90°, 1,080° (3 rotations), 8,640° (24 rotations) from the position in FIG. 13A, respectively.

FIG. 3 and FIGS. 12A, 12B to 14A to 14D will be referred to. As shown in FIG. 12A, a phase (rotation angle) difference in the rotation cycles of the gears D and E is a delay by −30° (advance by 30°) and that of the gears D and F is a delay by −50° (advance by 50°). In this case, with one rotation of the drum drive gear 41 at the same cycle as that of the gear D, the gear E will be rotated by ((360+30)/360)=13/12 while the gear F will be rotated by ((360+50)/360)=41/36 (FIG. 12B). Suppose that the velocity fluctuations and rotation angles of the photoreceptor drums 1M, 1K are coherent with each other if the magenta photoreceptor drum 1M is further rotated by +90°, the gear E by +180°, and the gear F by +30° (FIGS. 13A to 13E). With the +90° rotation of the photoreceptor drum 1M, the gear E is rotated by +82.5° and the gear F by 77.5 so that they have to be further rotated by 97.5° (−262.5°) and by −47.5°, respectively.

Figure 14B:
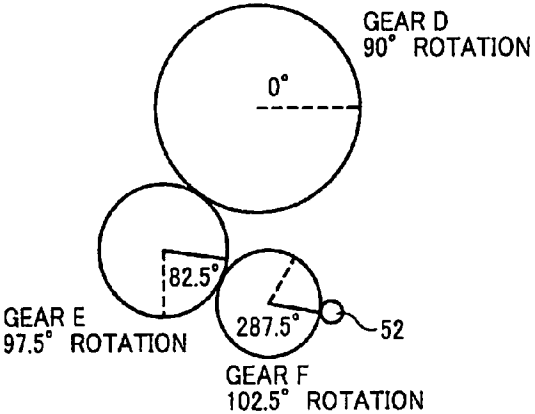

Next, an example of maintaining the phase difference of the photoreceptor drums 1M, 1K and adjusting phase differences of the gears for the rest of the photoreceptor drums will be described. The gears are assumed to be rotated in a direction of positive phase (rotation) angles. The target positions are indicated by broken lines in FIG. 14A. As shown in FIG. 14B, when the gear D is rotated by 90° from the position in FIG. 14A to the reference position (0° in phase or rotation angle), the gear E is rotated by 90×13/12=97.5° from the position at 180° in FIG. 14A, that is, delayed by −82.5° (180+97.5=277.5, 277.5−360=−82.5) from 180° in FIG. 14B. Likewise, the gear F is rotated by 90×41/36=102.5°, that is, rotated by 287.5° (30−102.5=−72.5°, 360−72.5=287.5°) from the position at 30° in FIG. 14A.

With triple rotation (1,080°) of the gear D from the position in FIG. 14B, the gear E is rotated by 1,080×13/12=1170°. The phase θ thereof is calculated by 1170−360×n (n being a positive integer satisfying −360<θ<360) in the present embodiment. Accordingly, the phase θ of the gear D from the reference position is 82.5−90=−7.5° from 1,170−1,080=90° in FIG. 14C. Also, the gear F is rotated by 1080×41/36=1,230° from the position in FIG. 14B, and rotated by 287.5−150=137.5° (−72.5−150=−222.5°) from the current position (287.5°, −72.5°).

Figure 14C:
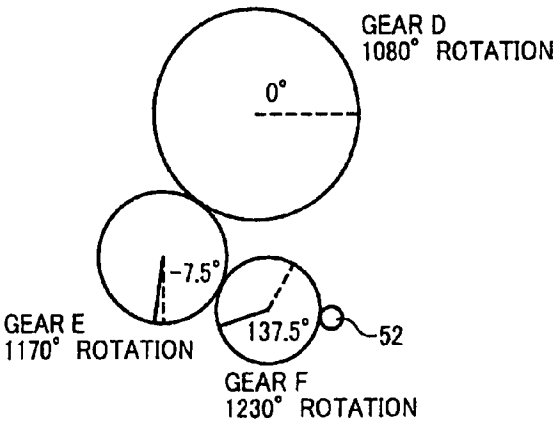
Figure 14D:
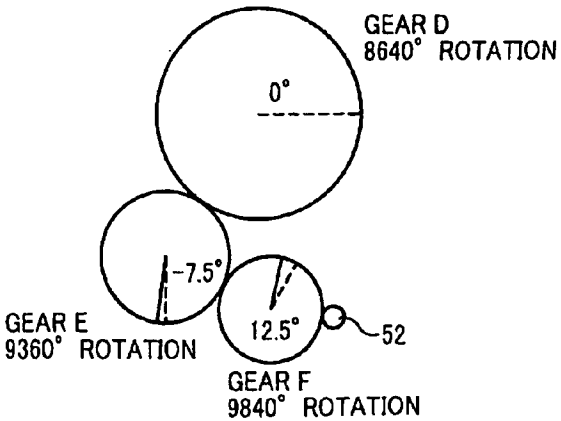

Moreover, with 24 rotations (8,640°) of the gear D from the position in FIG. 14C, the gear E is rotated by 8,640×13/12=9,360°. The phase (rotation angle) thereof is −7.5, the same as that in FIG. 14C when −360×n (n=26), that is, the gear E is delayed in phase by −7.5° from the reference position (FIG. 14D). Further, the gear F is rotated by 8,640×41/36=9,840° (by 120° in phase) from the position in FIG. 14C, and rotated by 137.5−120=17.5° (FIG. 14D) from the current position at 137.5° (−222.5°).

From the above, it is found that in order to reduce color shifts to a minimum, the drive gear needs to be controlled to rotate the gear D (gear ratio) by 90+360×(1+3+24)=10,170° (FIG. 14A to 14D). The phase difference adjustment can be performed to deal with a certain velocity fluctuation preferentially or to reduce color shifts due to all of velocity fluctuations equally. Furthermore, the phase of the velocity fluctuation of the color photoreceptor drums can be adjusted in a period from reception of a print job to start of printing, or after completion of a previous print job.

Figure 15:
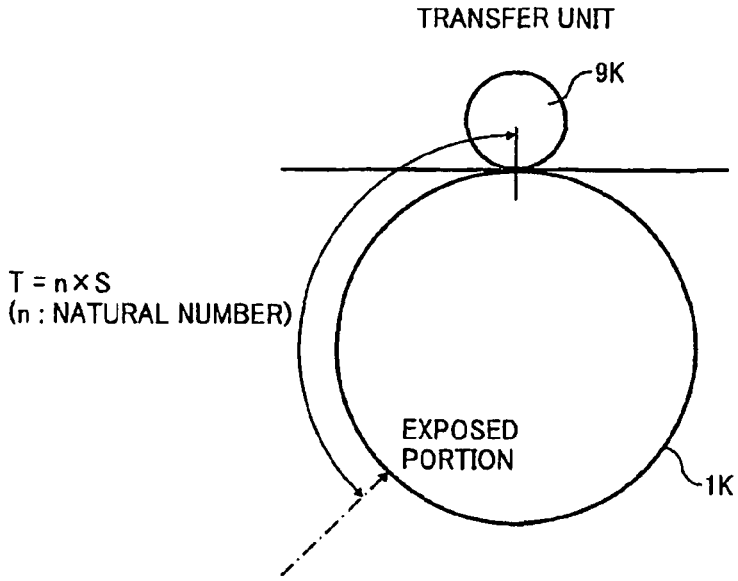
FIG. 15 shows a distance from an exposed portion of the black photoreceptor drum to a transfer unit.
Figure 16:
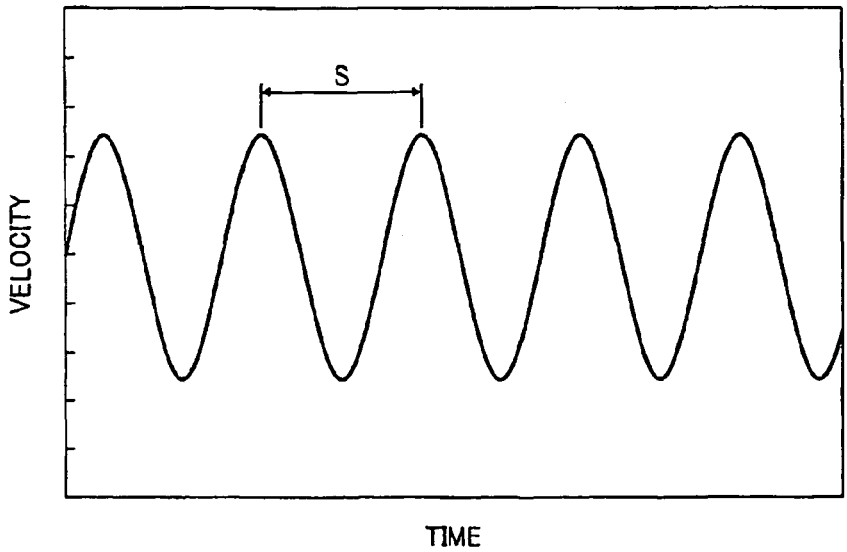
FIG. 16 is a graph showing the rotation cycle of a transfer belt idle gear for the photoreceptor drums and the intermediate transfer belt.

FIG. 15 shows a moving distance of the black photoreceptor drum 1K from an exposed portion to the primary transfer roller 9K and FIG. 16 is a graph showing the rotation cycle of the belt idle gear 42 (FIG. 3) and a single rotation cycle S. Setting the rotation cycle of the belt idle gear 42 (second drive element) to 1/n-th (n=integer) of a distance from the exposed position to the primary transfer roller 9K makes it possible to allow the velocity of the photoreceptor drum 1K at exposure to coincide with that at transfer. Accordingly, a registration error in toner images is preventable. This eliminates the necessity of providing phase adjusting gears for the idle gears of the other color photoreceptor drums, and leads to reducing manufacture costs and time for phase adjustment.

Thus, the drive element connecting the belt drive motor and the intermediate transfer unit to drive them together is configured to be rotated at a cycle as 1/n-th of an exposed position to a transfer position on the photoreceptor drum 1K. This makes it possible to rotate the photoreceptor drum 1K at the same speed at exposure and at transfer, reducing the number of drive elements for the photoreceptor drum 1K driven by the different drum drive motor from the belt drive motor. Accordingly, it is possible to achieve an imaging system which can generate images with less color shifts at a low cost.

Furthermore, the cycle T1 of the velocity fluctuation of the intermediate transfer belt (FIG. 3) and that T2 of the photoreceptor drum 1K are set to satisfy a relation other than the expression, T2=(T1/2)×n (n being natural number). This is because at T2=(T1/2)×n, the phase (rotation angle) difference between the photoreceptor drum 1K and the transfer belt 8 is changeable only in unit of 180°. There is a possibility that color shifts in toner images cannot be reduced depending on an operating condition. Therefore, the drive elements of the photoreceptor drum 1K and the intermediate transfer belt 8 have to be chosen not to satisfy the expression for the sake of reliable phase adjustment. This also makes the phase differences of the photoreceptor drums and those of the corresponding drive elements concurrently adjusted, resulting in generating high-quality images with less color shift at a low cost.

As described above, to adjust the phase differences of the velocity fluctuating elements, the drum drive gears need be repetitively rotated. When the black photoreceptor drum 1K closely contact with the intermediate transfer belt 8 during the phase adjustment, the same position of the intermediate transfer belt 8 is used and the position may be rubbed and damaged. To prevent this from occurring, it is preferable to provide a not-shown disjunctive mechanism in the intermediate transfer belt in order to separate the photoreceptor drum 1K and the intermediate transfer belt 8.

Moreover, with use of gears, the resolution of phase (rotation angle) by velocity fluctuation is determined depending on the size and precision of the gears and other drive elements. Because of this, the optimal phase relation among the elements may not be established to prevent all the velocity fluctuations. In such a case, since the shorter the cycle of velocity fluctuation, the larger the phase shift amount per unit time, color shifts in images can be substantially reduced by adjusting a phase difference in the gears to be coherent with a phase difference of one having the shortest velocity fluctuation cycle. For example, preferentially adjusting a phase difference of one of the photoreceptor drum 1K and the drum drive gear, the one with a shorter velocity fluctuation cycle, makes it possible to reduce an error in phase difference adjustment to a minimum and resulting in generating images with less color shifts.

Generally, a tandem type color imaging system is used for generating both color and monochrome images, and in the monochrome printing mode images are most printed in black. Further, to shorten a first print time, it is advantageous that a primary transfer unit and a secondary transfer unit are arranged with a close distance to decrease a distance in which toner is delivered. This also makes it possible to concurrently drive one of the photoreceptor drums and the intermediate transfer belt by a single motor, realizing a printer with less electric consumption.

Thus, setting the black photoreceptor drum to be the one driven by the belt drive motor can reduce the number of motors driven in the monochrome printing mode, realizing an electricity-saving color imaging system.

FOURTH AND FIFTH EXAMPLES

Figure 17:
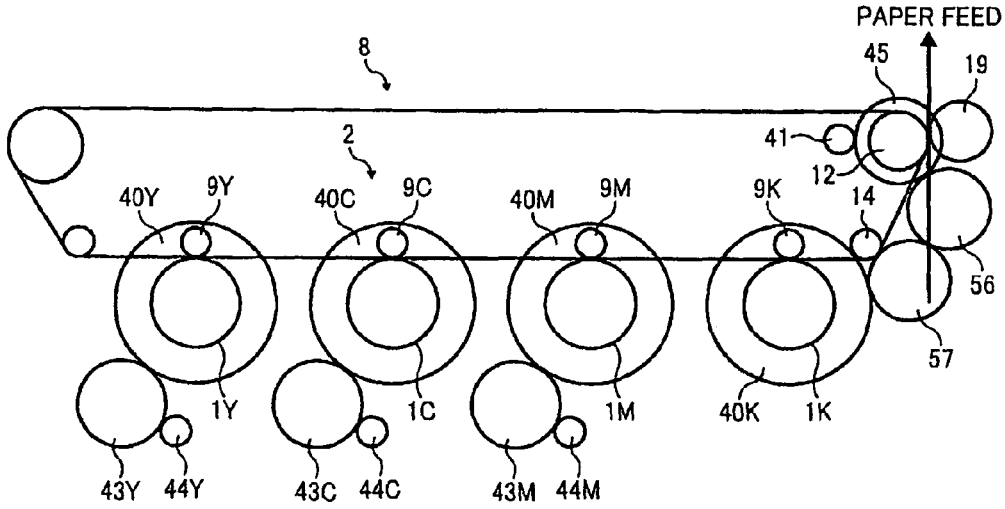
FIG. 17 schematically shows a fourth example of the drive system.
Figure 18:
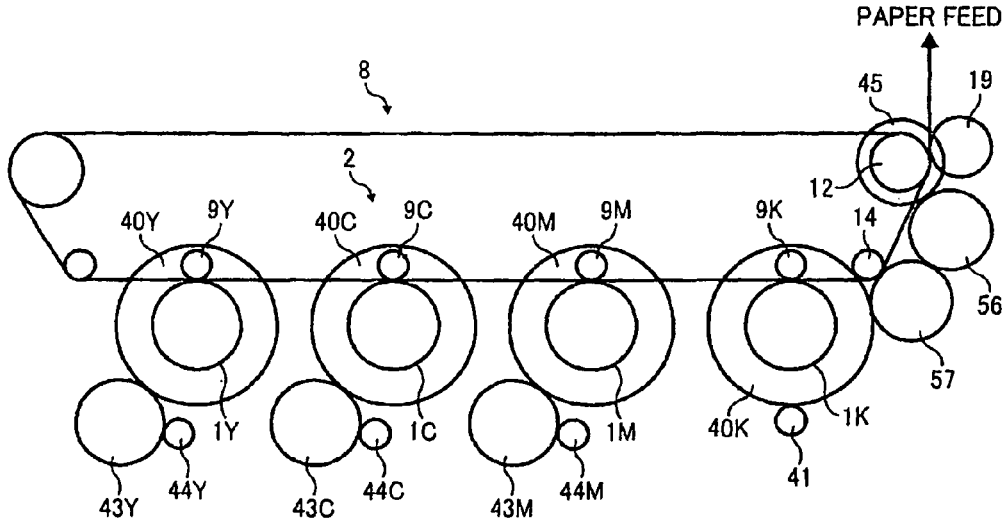
FIG. 18 schematically shows a fifth example of the drive system.

FIGS. 17, 18 show fourth and fifth examples of a drive system for the photoreceptor drums and intermediate transfer belt, respectively.

Referring to FIGS. 17, 18, the drive roller 12 for the intermediate transfer belt 8 and the black photoreceptor drum 1K are rotated by drive force of the drive motor 41 (drive unit) in the printer 100 (FIG. 1). The other photoreceptor drums 1Y, 1M, 1C are connected with drive motors 44Y, 44M, 44C via phase adjusting gears 43Y, 43C, 43M and rotated by the drive motors, respectively.

Specifically, in FIG. 17 the drive motor 41 (gear on the drive shaft of drive motor) is connected with the belt drive gear 45 which is coaxial with the belt drive roller 12 to rotate the intermediate transfer belt 8. Also, it is connected with the drum drive gear 40K via idle gears 56, 57 to rotate the photoreceptor drum 1K.

Meanwhile, in FIG. 18 unlike in FIG. 17, the drum drive gear 40K is driven by drive force of the drive motor 41 to drive the belt drive gear 45 via the idle gears 56, 57 and rotate the intermediate transfer belt 8. Since the drum drive gear 40K and the intermediate transfer belt 8 are driven by the drive motor 41, when a fluctuation in the velocity of the belt drive gear 45 is adjusted to rotate the intermediate transfer belt 8 at a constant velocity (feedback control), the adjusted velocity fluctuation is transmitted to the drum drive gear 40K.

Without the phase adjusting gears 43Y, 43C, 43M, the drum drive gears 40Y, 40C, 40M are driven by the respective drive motors; therefore, they are not affected by the feedback control over the intermediate transfer belt 8 (or velocity fluctuation of the belt drive gear 45). Accordingly, a fluctuation in the rotary velocities between the photoreceptor drum 1K and the other photoreceptor drums 1Y, 1C, 1M will occur.

However, with the phase adjusting gears 43Y, 43C, 43M having the same rotary cycle as that of the belt drive gear 45 in FIGS. 17, 18, the drum drive gear 40K and the other drum drive gears 40Y, 40C, 40M can be set to fluctuate in velocity at the same time.

However, there still remains a fluctuation in the velocities among the photoreceptor drums since the drum drive gear 40K is affected by a velocity fluctuation of the idle gears 56, 57 which are provided between the belt drive gear 45.

In view of eliminating the fluctuation, the idle gears 56, 57 can be made of members having the same rotary cycle and assembled so that their rotary phases are shifted from each other by 180 degrees (reverse to each other). Thereby, the velocity fluctuations of the idle gears 56, 57 can negate with each other, and the drum drive gear 40K is not affected by the fluctuations, which can resolve the velocity fluctuations among the photoreceptor drums and accurately adjust them in phase. Accordingly, it is possible to prevent color shifts in the toner images on the intermediate transfer belt 8.

Figure 19:
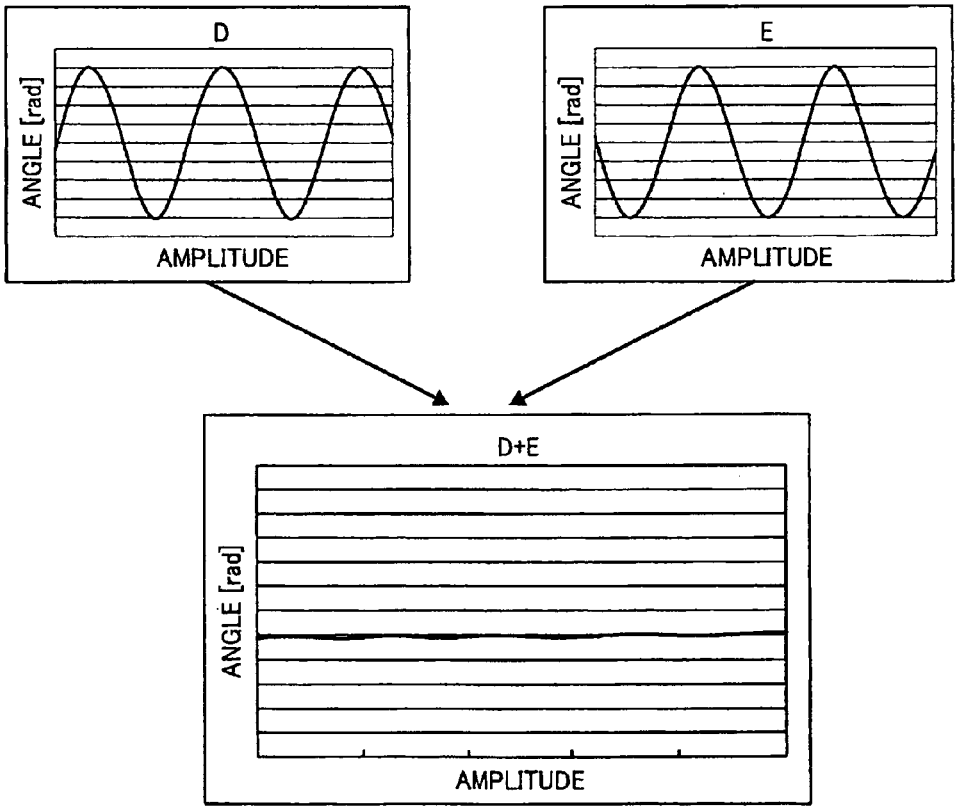
FIG. 19 shows frequency waveforms and a synthetic wave of velocity fluctuations in drive gears when a phase reversing gear is provided, with a phase shift of 180 degrees between velocity fluctuations of a transfer unit driver and one of the photoreceptors which is driven together with a transfer unit by the transfer unit driver.

FIG. 19 shows frequency waveforms (D), (E) of rotary velocity fluctuation in the idle gear 56 shifted in phase by 180 degrees from the idle gear 45, and a synthetic wave (D+E). As shown in the synthetic wave of FIG. 19, the velocity fluctuations arising from the eccentricities of the idle gears 56, 57 negate with each other. Accordingly, the black photoreceptor drum 1K driven together with the intermediate transfer belt can be prevented from being affected by the rotary velocity fluctuation of the idle gears 56, 57. In addition, the idle gears 56, 57 can be placed in different positions as shown in FIG. 17 to FIG. 19 as long as they are connected between the black photoreceptor drum 1K and the intermediate transfer belt 8 and rotated in the right direction.

The drive systems in FIGS. 17, 18 can be made of much less number of gears than those in FIGS. 3 to 6, so that a multicolor imaging system including such a drive system can generate high quality images with low cost.

Furthermore, with regard to the rotation control shown in FIG. 14, only a single phase adjusting gear has to be controlled to rotate to its reference position in these drive systems, compared with controlling the two kinds of phase adjusting gears in FIG. 3 to rotate to their respective reference positions, for example. This can accordingly simplify the gear rotation control and reduce a wait time (time taken for phase adjustment).

As described above, the multicolor imaging system according to the present invention is configured to include a drive element (phase adjusting gear) for each photoreceptor which causes a velocity fluctuation in the photoreceptors at a same cycle as that of the transfer unit. This enables registration errors in four color toner images on the no-end belt to be reduced by concurrently adjusting the phase differences in the velocity fluctuations of the photoreceptors and the drive element. Accordingly, the imaging system can generate images with less color shifts with low cost.

Although the present invention has been described in terms of exemplary embodiments, it is not limited thereto. It should be appreciated that fluctuations may be made in the embodiments described by persons skilled in the art without departing from the scope of the present invention as defined by the following claims.

What is claimed is:

1. A multicolor imaging system comprising:

a plurality of photoreceptors on which electrostatic latent images are generated;

a plurality of develop units generating toner images based on the electrostatic latent images on the photoreceptors, respectively;

a transfer unit comprising a no-end belt element onto which the toner images are transferred sequentially while rotated, and a belt drive element which rotates the belt element;

a drive unit controlling the transfer unit via the belt drive element based on a fluctuation in a rotary velocity of the belt element so that the belt element rotates at a constant velocity, and driving one of the plurality of photoreceptors together with the belt element;

a toner pattern detector which detects a toner pattern on the belt element;

an arithmetic unit which calculates a periodic fluctuation in each of the photoreceptors from information detected by the toner pattern detector;

a rotary position detector which detects rotary positions of the photoreceptors;

a controller which adjusts a phase difference in rotations of the photoreceptors based on information detected by the rotary position detector;

a drive gear system for the one photoreceptor, comprised of a gear and the belt drive element; and a gear system for the photoreceptors other than the one photoreceptor, comprised of a gear and at least one phase adjusting gear having a same rotary cycle as that of the gear of the drive gear system to adjust the rotary velocity of the photoreceptors other than the one photoreceptor to fluctuate in a same cycle as that of the one photoreceptor.

2. A multicolor imaging system according to claim 1, wherein:

the drive gear system includes an idle gear connected with the drive unit;

the belt drive element is driven by the drive unit;

the one photoreceptor is driven by the idle gear;

the at least one phase adjusting gear is a first phase adjusting gear having a same rotary cycle as that of the belt drive element and a second phase adjusting gear having a same rotary cycle as that of the idle gear; and the photoreceptors other than the one photoreceptor are driven by the first and second phase adjusting gears.

3. A multicolor imaging system according to claim 1, wherein:

the drive gear system includes a pair of idle gears having a same rotary cycle;

the one photoreceptor is driven by the drive unit;

the belt drive element is driven by the gear of the drive system and the pair of idle gears;

the at least one phase adjusting gear is a first phase adjusting gear having a same rotary cycle as that of the belt drive element and a second phase adjusting gear having a same rotary cycle as that of the pair of idle gears; and the photoreceptors other than the one photoreceptor are driven by the first and second phase adjusting gears.

4. A multicolor imaging system according to claim 1, further comprising a driver different from the drive unit, wherein:

the drive gear system includes an idle gear connected with the drive unit;

the belt drive element is driven by the drive unit;

the one photoreceptor is driven by the idle gear;

the at least one phase adjusting gear is a first phase adjusting gear having a same rotary cycle as that of the belt drive element and being driven by the driver and a second phase adjusting gear connected with the first phase adjusting gear and having a same rotary cycle as that of the idle gear; and the photoreceptors other than the one photoreceptor are driven by the first and second phase adjusting gears.

5. A multicolor imaging system according to claim 1, wherein the one photoreceptor driven by the drive unit is a black photoreceptor.

6. A multicolor imaging system comprising:

a plurality of photoreceptors on which electrostatic latent images are generated;

a plurality of develop units generating toner images based on the electrostatic latent images on the photoreceptors, respectively;

a no-end paper carrier on which a sheet of paper is carried and being rotated so that the toner images are transferred onto the sheet of paper sequentially;

a paper carrier drive element rotating the paper carrier;

a drive unit controlling the paper carrier drive element based on a fluctuation in a rotary velocity of the paper carrier so that the paper carrier rotates at a constant velocity, and driving one of the plurality of photoreceptors concurrently with the paper carrier;

a toner pattern detector which detects a toner pattern on the paper carrier;

an arithmetic unit which calculates a periodic fluctuation in a rotary velocity of each of the photoreceptors from information detected by the toner pattern detector;

a rotary position detector which detects rotary positions of the photoreceptors;

a controller which adjusts a phase difference between rotations of the photoreceptors based on information detected by the rotary position detector;

a drive gear system for the one photoreceptor, comprised of a gear and the paper carrier drive element; and a gear system for the photoreceptors other than the one photoreceptor, comprised of a gear and at least one phase adjusting gear having a same rotary cycle as that of the gear of the drive gear system to adjust the rotary velocity of the photoreceptors other than the one photoreceptor to fluctuate in a same cycle as that of the one photoreceptor.

7. A multicolor imaging system according to claim 6, wherein the one photoreceptor driven by the drive unit is a black photoreceptor.

8. A multicolor imaging system comprising a plurality of photoreceptors on which electrostatic latent images are generated;

a plurality of develop units generating toner images based on the electrostatic latent images on the photoreceptors, respectively;

a transfer unit comprising a no-end belt element onto which the toner images are transferred sequentially while rotated, and a belt drive element which rotates the belt element;

a drive unit controlling the transfer unit via the belt drive element based on a fluctuation in a rotary velocity of the belt element so that the belt element rotates at a constant velocity, and driving one of the plurality of photoreceptors together with the belt element;

a toner pattern detector which detects a toner pattern on the belt element;

an arithmetic unit which calculates a periodic fluctuation in each of the photoreceptors from information detected by the toner pattern detector;

a rotary position detector which detects rotary positions of the photoreceptors;

a controller which adjusts a phase difference in rotations of the photoreceptors based on information detected by the rotary position detector;

a drive gear system for the one photoreceptor, comprised of idle gears having a same rotary cycle and assembled so as to be reverse in phase to each other and to the belt drive element; and a gear system for the photoreceptors other than the one photoreceptor, comprised of a gear and at least one phase adjusting gear having a same rotary cycle as that of the belt drive element to adjust the rotary velocity of the photoreceptors other than the one photoreceptor to fluctuate in a same cycle as that of the one photoreceptor.

* * * * *